US007165356B1

(12) United States Patent
Broel

(10) Patent No.: US 7,165,356 B1
(45) Date of Patent: Jan. 23, 2007

(54) FLOWER HOLDER AND VASE INSERT

(76) Inventor: David J. Broel, P.O. Box 70934, Marietta, GA (US) 30007

( * ) Notice: Subject to any disclaimer, the term of this patent is extended or adjusted under 35 U.S.C. 154(b) by 0 days.

(21) Appl. No.: 10/728,401

(22) Filed: Dec. 8, 2003

(51) Int. Cl.
*A01G 5/00* (2006.01)

(52) U.S. Cl. ..... 47/41.01; 47/41.12; 248/27.8

(58) Field of Classification Search ..... 206/423; 27/30; 47/41.01, 41.1–41.15, 77, 73, 39, 47/44, 47, 66.7, 84; 248/27.8, 125.3, 176.1; D11/152–154, 143, 144, 146–149; D6/469; 428/23, 27, 19, 17, 24, 15, 26; 220/700; *A47G 7/03, A47G 7/02, 7/06, 7/07*
See application file for complete search history.

(56) References Cited

U.S. PATENT DOCUMENTS 649,874 A * 5/1900 Payne ..... 47/41.11
1,591,845 A * 7/1926 Kurtz ..... 248/146
3,148,480 A * 9/1964 Gallo ..... 47/41.12
3,165,863 A * 1/1965 Duran ..... 47/47
3,290,819 A * 12/1966 Turner ..... 47/41.1
3,354,580 A * 11/1967 Amortegui ..... 47/47
3,368,303 A * 2/1968 Tong ..... 47/41.12
3,868,787 A * 3/1975 Wong, Jr. ..... 47/62 R
4,386,480 A * 6/1983 Horowitz ..... 47/45
4,747,494 A * 5/1988 Tyson ..... 211/133.4
5,450,692 A * 9/1995 Ruibal ..... 47/83
5,546,697 A * 8/1996 Lymberis et al. ..... 47/41.15
6,004,635 A * 12/1999 Li ..... 428/23
6,128,855 A * 10/2000 Salamh et al. ..... 47/41.01
6,263,614 B1 * 7/2001 Koo ..... 47/41.14

FOREIGN PATENT DOCUMENTS

EP 427637 * 5/1991
FR 2620591 * 3/1989

OTHER PUBLICATIONS

English translation of French Patent FR 2620591 to Roder, Support for Flowers or Other Decorative objects that can be Inserted in the Same, 9 pages including cover page.*

* cited by examiner

*Primary Examiner*—Andrea M. Valenti
(74) *Attorney, Agent, or Firm*—Rodgers & Rodgers

(57) ABSTRACT

A flower holder having a base shaft and an upper shaft with a disc disposed therebetween, the upper portion of the upper shaft being enlarged, multiple flexible extensions extending from outwardly from the base shaft, and the upper shaft adapted to receive a foam insert.

2 Claims, 1 Drawing Sheet

FLOWER HOLDER AND VASE INSERT

BACKGROUND OF THE INVENTION

In current practice, artificial flowers are arranged at a florist shop by inserting the artificial flower stems into a cone or rectangular shaped floral foam piece for use in a cemetery. The problem is that there is not a standard vase size or a standard foam size. Most often, the foam must be cut or carved to fit into a cemetery vase. A major complaint received by cemetery employees is that of missing flower bouquets. Most often the culprit is the wind blowing the flowers away.

As the wind blows, the foam that is inside the vase begins to sway back and forth and slowly wears away as it scrapes the inside of the vase. Eventually, the wind will cause the flower bouquet to fly out of the vase. Another problem with the use of foam is that foam is porous and buoyant. Once the foam is placed into a vase, the water from rain seeps through the foam and fills the vase. As water fills the vase, there is upward pressure against the foam which forces the foam to float. The buoyant foam will eventually be pushed out of the vase by the rising water or blown out by the wind.

SUMMARY OF THE INVENTION

This invention comprises an all-in-one flower holder for displaying silk flower bouquets. The device is made up of a series of molded plastic shapes formed into one unit and includes multiple flexible extensions extending from a base shaft, a round disc abutting the top of the base shaft holds the specially designed foam at a preset height, a pair of stabilizing extensions disposed on top of the disc to prevent the foam from spinning, and an upper shaft extending from the disc into the foam.

DETAILED DESCRIPTION OF THE INVENTION

Figure 2:
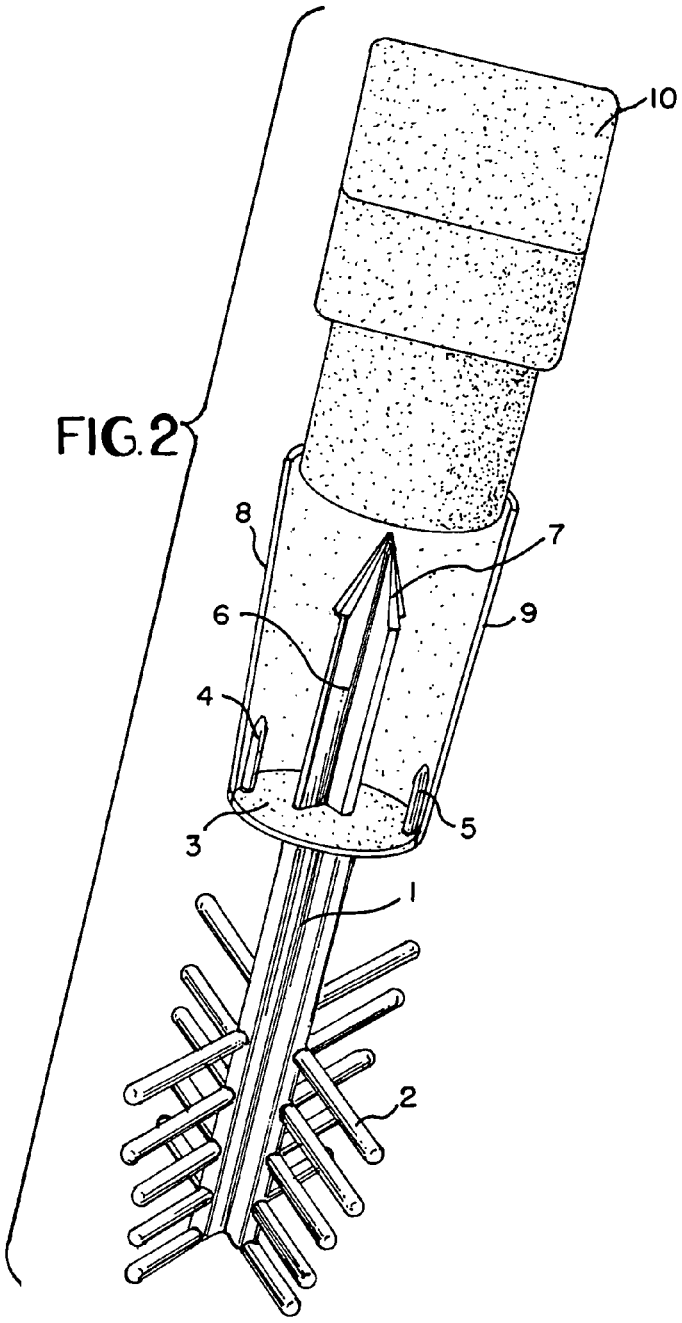
FIG. 2 is a perspective view showing the flower holder in an exploded condition.
Figure 1:
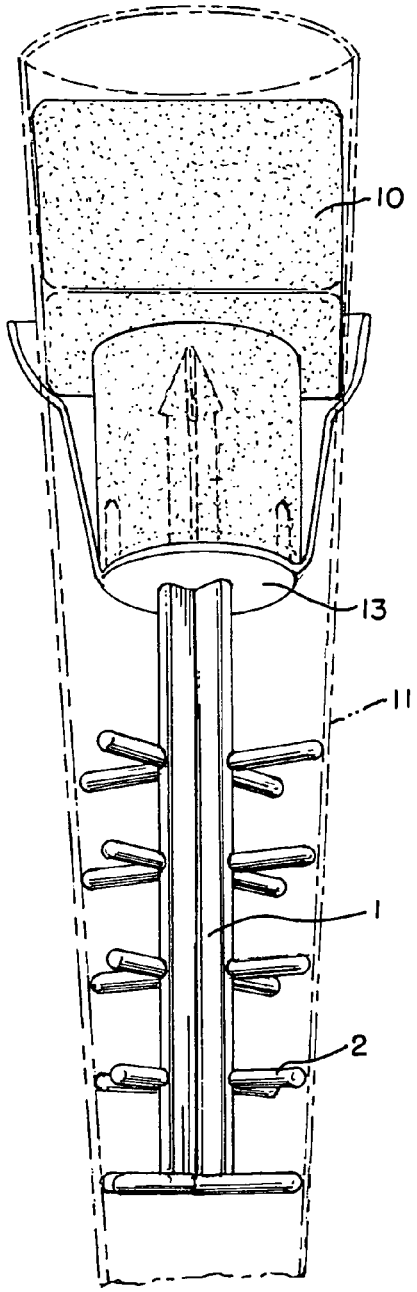
FIG. 1 is a front elevational view of the flower holder according to this invention.

In the drawings and with particular reference to FIG. 1, the numeral 1 designates the base shaft of the flower holder with multiple flexible extensions 2 integrally thereto and extending outwardly therefrom. Disc 3 is secured to the upper edge of base shaft 1 and includes prongs 4 and 5 integrally joined to disc 3 and extending upwardly therefrom. Also, upper shaft 6 extends upwardly from the middle of the upper surface of disc 3 with enlarged pointed tip 7 formed on the free end thereof. For the purpose of removing the flower holder from a cemetery vase, straps 8 and 9 are provided and are integrally joined to the outer edge of disc 3. For the purpose of receiving artificial flowers, foam insert 10 is utilized as is well known.

In operation, floral stems are forced into foam insert 10 in the desired arrangement and then foam insert 10 is pushed down onto pointed tip 7 and upper shaft 6 until the lower edge of foam insert 10 comes into contact with the upper surface of disc 3. Simultaneously with this operation, prongs 4 and 5 enter foam insert 10 and act to stabilize foam insert 10 and prevent it from spinning on upper shaft 6. The total lateral dimension of pointed tip 7 is larger than the diameter of upper shaft 6 which aids in stabilizing foam insert 10 and prevents its dislodgment. Following this, the flower holder is inserted into cemetery vase 11 and then appears as shown in FIG. 1.

According to this invention, extensions 2 are flexible such that when the flower holder is inserted into vase 11, extensions 2 abut against the inside of vase 11 and are flexed to a degree so that the flower holder is held firmly in vase 11 as shown in FIG. 1. When it is desired to remove the flower holder from vase 11, it is simply necessary to grasp foam insert 10 and pull it upwardly. For added convenience, straps 8 and 9 can be utilized to pull the entire unit upwardly out of vase 11.

Therefore by this invention, a flower holder is provided that is held securely within a cemetery vase without possibility of it being blown away due to the effects of wind and rain water.

The invention claimed is:

1. A cemetery flower holder and a vase comprising a shaft and multiple elongated straight extensions of substantially equal length, said extensions having free ends and being enclosed in said vase, each extension integrally secured at one end to periphery of said shaft and extending outwardly from said shaft substantially 90 degrees thereto with said free end thereof in abutment with an inner surface of said vase such that said extensions are deformed and remain deformed by means of the length of said extensions being greater than the distance between said shaft and the inner surface of said vase, said extensions comprising at least three levels with each level comprising at least three extensions, each of said extensions being cylindrical in shape, said shaft comprising a base shaft and an upper shaft with a disc disposed therebetween, said disc comprising an upper surface, at least one prong extending upwardly from said upper surface, and a foam insert substantially enveloping said prong.

2. A cemetery flower holder according to claim 1 wherein the end of said upper shaft remote from said disc is enlarged.

* * * * *